US008104776B2

(12) United States Patent
Messmer et al.

(10) Patent No.: US 8,104,776 B2
(45) Date of Patent: Jan. 31, 2012

(54) SNOWBOARD BINDING

(75) Inventors: Karl Messmer, Schliersee (DE); Andreas Seebauer, Riedering (DE)

(73) Assignee: Head Sport AG, Kennalbach (AT)

( * ) Notice: Subject to any disclaimer, the term of this patent is extended or adjusted under 35 U.S.C. 154(b) by 1054 days.

(21) Appl. No.: 10/567,588

(22) PCT Filed: Jul. 27, 2004

(86) PCT No.: PCT/EP2004/008404

§ 371 (c)(1),
(2), (4) Date: Mar. 3, 2008

(87) PCT Pub. No.: WO2005/016468

PCT Pub. Date: Feb. 24, 2005

(65) Prior Publication Data

US 2008/0150258 A1 Jun. 26, 2008

(30) Foreign Application Priority Data

Aug. 6, 2003 (DE) ..... 103 35 850

(51) Int. Cl.
*A63C 9/00* (2006.01)

(52) U.S. Cl. ..... 280/14.24

(58) Field of Classification Search ..... 280/11.3, 280/14.21–14.24, 611

See application file for complete search history.

(56) References Cited

U.S. PATENT DOCUMENTS

| | | | | |
|---|---|---|---|---|
| 5,236,216 | A * | 8/1993 | Ratzek | 280/607 |
| 5,261,689 | A | 11/1993 | Carpenter et al. | |
| 5,354,088 | A * | 10/1994 | Vetter et al. | 280/618 |
| 5,762,358 | A * | 6/1998 | Hale | 280/607 |
| 5,803,481 | A * | 9/1998 | Eaton et al. | 280/633 |
| 5,876,045 | A * | 3/1999 | Acuna, Jr. | 280/14.24 |
| 5,897,128 | A * | 4/1999 | McKenzie et al. | 280/607 |
| 6,155,591 | A * | 12/2000 | Huffman et al. | 280/618 |
| 6,234,494 | B1 | 5/2001 | Gien | |
| 6,302,411 | B1 | 10/2001 | Huffman et al. | |
| 6,783,146 | B1 * | 8/2004 | Coing | 280/618 |
| 7,090,228 | B2 * | 8/2006 | Reynolds | 280/14.24 |

FOREIGN PATENT DOCUMENTS

| | | |
|---|---|---|
| DE | 200 00 947 U1 | 5/2000 |
| EP | 0 624 112 B1 | 11/1994 |
| EP | 0 761 261 A1 | 3/1997 |
| FR | 2 726 480 | 5/1996 |
| FR | 2 755 025 | 4/1998 |

OTHER PUBLICATIONS

PCT International Search Report mailed Nov. 11, 2004 (2 pages).
German Patent Office Search Report dated May 19, 2004.

* cited by examiner

*Primary Examiner* — Jeffrey J Restifo
*Assistant Examiner* — Travis Coolman
(74) *Attorney, Agent, or Firm* — Miller Canfield Paddock and Stone PLC; Mark L. Maki

(57) ABSTRACT

The invention relates to a snowboard binding comprising a base plate (1) and a central plate (6) that is situated in a circular central opening (5) in the center of the base plate (1). The peripheral section of the central plate (6), which tapers towards the snowboard (8), lies against an edge section (9) of the base plate (1), which widens away from the snowboard (8) and is equipped with fixing openings (11) for the fixing elements that fix said plate to the snowboard (8). A locking device (B) on the edge section (9) of the base plate (1) around the central opening (5) locks the central plate (6) in position on the base plate (1), preventing torsion.

17 Claims, 1 Drawing Sheet

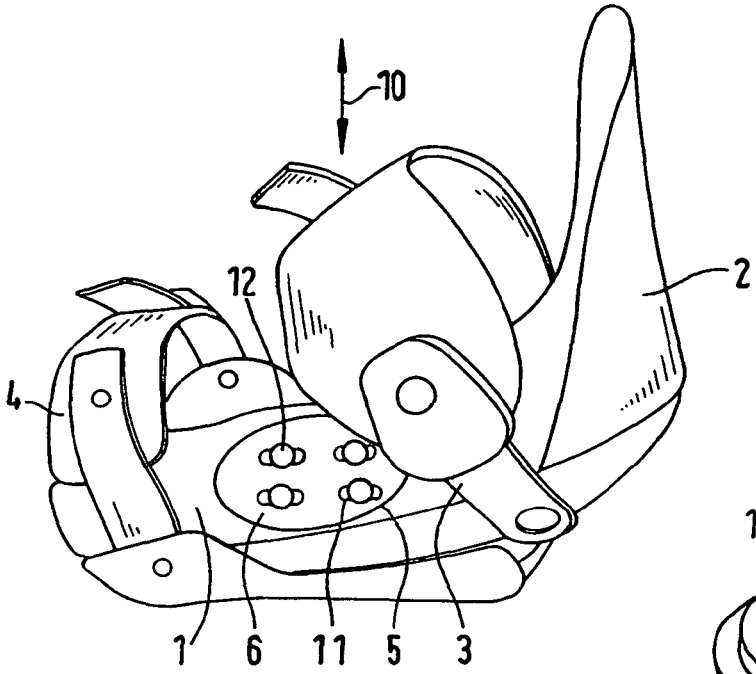
FIG.1
FIG. 3
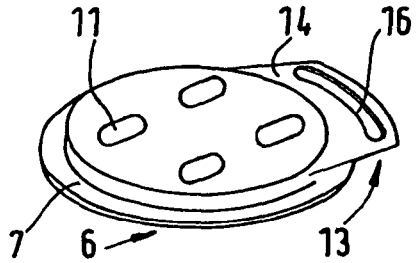
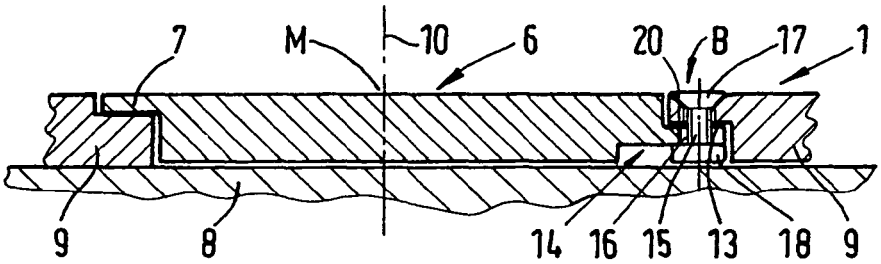
FIG. 2
FIG. 4
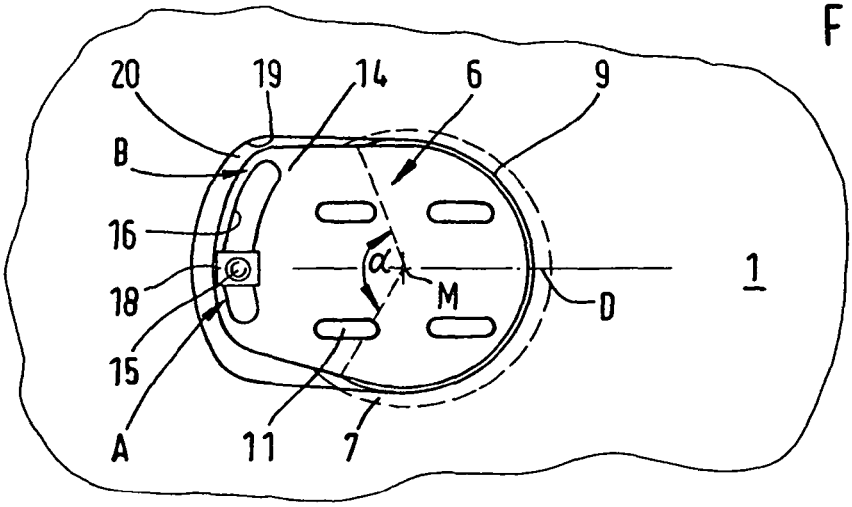

SNOWBOARD BINDING

The invention relates to a snowboard binding according to the generic part of claim 1.

Snowboard bindings of this kind are known (compare EP 0 624 112 B1, for example). In these the base plate can be rotated through 360° relative to the center disk. To lock the rotational movement the circumferential section of the center disk which is tapered conically or in steps, for example, towards the snowboard is provided with a toothing arrangement which mates with a corresponding toothing arrangement on the edge section of the base plate, expanding away from the snowboard, around the center opening. Screws are used as fastening elements which are screwed through the fastening openings in the center disk into inserts incorporated in the snowboard.

To prevent the base plate from rotating the toothing arrangements must be pressed together using a very high contact pressure, i.e. a torsional hold of 200 Nm is required. With the known bindings this results in the center disk being designed somewhat thinner so that its bottom side is offset with respect to the bottom side of the base plate by 2 mm, for example, in upward direction. Upon tightening of the fastening screws this causes a pulling up of the relatively flexible snowboard in this area and the running surface of the snowboard underneath the binding becomes concave. This has a distinctly negative impact on the riding performance and makes edge change and straight ahead control more difficult.

For the individual positioning of the binding on the snowboard the center disk has elongated holes which run parallel to the diameter of the center disk on both sides of the center disk. If the position of the binding is to be changed the screws have to be slackened. This can result in the stance angle, that is the angle of the base plate with respect to the axis running transverse to the snowboard, being unintentionally altered at the same time.

It is the object of the invention to provide a snowboard binding which, with a base plate reliably secured against rotational movement, does not lead to any distortion of the snowboard surface when tightening the fixing screw. At the same time, if the center disk is provided with elongated holes, there is to be no alteration to the stance angle when changing the position of the binding on the snowboard.

According to the invention this is achieved with the snowboard binding characterized in claim 1.

Favorable embodiments of the invention are specified in the sub-claims.

The snowboard binding according to the invention is provided with at least one locking device which is arranged on the edge section of the base plate around the center opening. By means of this additional locking device the center disk is fixed on the base plate in such a way that it cannot be rotated relative to the base plate. That is, the anchoring of the center disk and with it the base plate, in vertical direction to the snowboard, takes place as before using fastening elements such as screws, for example, which are screwed into the inserts in the snowboard through the fastening openings in the middle disk, while the locking device fixes the center disk on the base plate against rotational movement.

According to the invention there is no need for toothing arrangements to be provided on the center disk circumferential section which is tapered towards the snowboard and on the edge section of the base plate expanding away from the snowboard, around the base plate center opening, which have to be pressed together to prevent rotational movement of the base plate with respect to the center disk. That is, the circumferential section of the center disk and the edge section of the base plate can, according to the invention, be designed without toothing arrangements, thus having a smooth design.

For this reason, according to the invention, the bottom side of the center disk can be flush with the bottom side of the base plate so that the snowboard is not distorted during the tightening of the fastening screws, meaning that the running surface under the binding is not deformed. As a result of this, according to the invention, the base plate is arranged with its bottom side resting on the snowboard preferably at a maximum of 0.5 mm above the bottom side of the center disk.

The locking device is preferably designed in such a way that it presses a contact surface on the circumferential section of the center disk against a contact surface on the base plate. For pressing the two contact surfaces against each other the locking device preferably has a screw which engages in the center disk and in the base plate in the area of the contact surfaces.

In this way, the stance angle can be adjusted by actuating one single screw, whereas hitherto all fastening screws on the center disk had to be slackened.

In addition to this, the locking device or the screw ensures that the center disk is also fixed to the binding during the transport up until assembly of the binding, and is not loose in a box or similar container, as was hitherto the case.

The contact surface of the center disk is preferably formed by a radially extending projection at the center disk. The contact surface of the base plate at which the projection makes contact is preferably provided in a recess, on the bottom side of the base plate, for example. To ensure that the center disk can be fixed against rotational movement with respect to the base plate to the required 200 Nm, a frictional connection by means of a corresponding material, or a positive engagement by means of a toothing arrangement, for example, is provided at the contact surfaces that are pressed together.

In order to be able to press the contact surface on the projection against the contact surface on the base plate using the screw there is preferably a slit provided in the projection or in the base plate, which has a circular arc design with the middle of the center disk as center of the circle. The screw extends through this slit, whereby it is provided with an extension which overlaps the slit in the projection on the side of the projection facing away from the base plate, that is, on the bottom side of the projection, whereas in the case of a slit in the base plate the extension overlaps the base plate on the side facing away from the projection. The extension can be provided on a nut into which the screw is bolted or it can be a screw head.

In the angular area in which the contact surface is provided on the base plate, there is a recess in the edge section of the base plate extending away from the snowboard. As a result of this, the surface on which the center disk rests with its circumferential section on the base plate is correspondingly reduced.

This angular area on which the base plate has this recess can, however, be kept so small that this has no noticeable impairment on the fixing of the binding vertical to the snowboard.

During the snowboarding the snowboard rider either has the left foot forward in the direction of travel, referred to as "regular" style, or the right foot forward, referred to as "Goofy" style.

When the base plate in its longitudinal direction is positioned exactly transverse to the snowboard this is referred to as 0° stance angle. The front foot in the direction of travel usually has a stance angle of between 10° and 35° in the direction of travel. The rear foot is usually positioned at a stance angle of 10° in the direction of travel up to 10° away from the direction of travel. When taking both riding styles into account an adjustment range of both bindings of 10° towards each other and 35° to the outside is then sufficient. This results in a maximum adjustment range of 45° which covers both riding styles.

Accordingly, the curved shaped slit in the projection preferably has a maximum angle of 45° and with a maximum safety margin of 60°. The angle of the recess in the expanding edge area of the base plate can be correspondingly small. I.e., the edge section of the base plate expanding away from the snowboard, around the center opening, on which the center disk rests with its circumferential section tapered towards the snowboard, can, in the binding according to the invention, be at least 240° without difficulty, ensuring in this way a reliable fixing of the binding vertical to the snowboard.

The circumferential section of the center disk tapered towards the snowboard and the edge section of the base plate expanding away from the snowboard, around the center opening, can be of a concave design, with curved or stepped cross section. In the stepped design there is preferably only one step, i.e., the center disk has at its bottom side, and the base plate has at its upper side an outward or inward extending radial flange respectively.

There are generally three or four fastening openings provided in the center disk for the fastening screws or similar fastening means. Whereby, in the case of four fastening openings, there are respectively two provided on the one half and two on the other half of the disk and, in the case of three fastening openings, there are two on the one side and one on the other side. The two openings in the one half are arranged at the same distance from the diameter of the center disk as the two openings or the one opening in the other half of the center disk.

In order to be able to adjust the binding on the snowboard in transverse direction the fastening openings are preferably designed as elongated holes which run parallel to the diameter on both sides of the center disk.

In order to manage with a curved slit with an angle of e.g. max. 45° this diameter must intersect the curved slit asymmetrically, i.e. in such a way that the slit has a section with 10° and a section with 35°, wherein the shorter section, that is the 10° section for the left foot, when viewing the center disk from above, is on the right side and the shorter section or the 10° section for the right foot, when viewing the center disk from above, is on the left side.

Based on the asymmetrical design of the center disk for the left or right foot it is necessary to use two injection moulds in the production of the center disk. As parts of this kind have to be manufactured with multiple tools anyway, this does not involve additional manufacturing costs worth mentioning.

The invention shall now be described in detail using the drawing. The drawing shows:

FIG. 1 a perspective view of a snowboard binding;

FIG. 2 a longitudinal section through part of a binding according to FIG. 1;

FIG. 3 a perspective view of the center disk from below; and

FIG. 4 a view of the binding from below.

According to FIG. 1 the Softboot snowboard binding has a base plate 1 to which a highback 2 as well as an angle strap 3 and a toe strap 4 are attached. In a circular center opening 5 in the center of the base plate 1 there is a center disk 6 which is provided with a radial flange 7 on its upper side (FIGS. 2 and 3) so that the center disk features a stepped circumferential section tapered towards the snowboard 8. Thus the circumferential section tapered towards the snowboard 8 results from the disk diameter across the circumferential section of the center disk being larger than the disk diameter of the section oriented towards and adjacent the snowboard. The base plate 1 is also provided with a radial flange 9 around the center opening 5 so that the base plate 1 has an edge section which expands stepwise away from the snowboard 8. The flanges 7 and 9, which are of a smooth design, are arranged one on top of the other. For fastening the center disk 6 and subsequently the base plate 1 on the snowboard 8 in vertical direction 10 there are four elongated holes 11 provided in the center disk 6 into which screws 12 engage which are screwed into inserts (not shown) in the snowboard 8.

A locking device B is provided to fix the base plate 1 against rotational movement, said device being designed in such a way that it presses a contact surface 13 on a radial projection 14 on the center disk 6 towards the snowboard, this being in vertical direction 10, against a contact surface 20 of the base plate 1. The locking device B is formed by a screw 15 which penetrates a slit 16 in the projection 14. The slit 16 has a circular arc design with respect to the middle M of the center disk 6. The bolt 15 which also penetrates the base plate 1, rests with its head 17 on the upper side of the base plate 1, whilst bolted into a nut 18 at the bottom end which overlaps the slit 16. The projection 14 engages in a recess 19 on the bottom side of the base plate 1, in which the contact surface 20 is arranged.

In the area of the angle $\alpha$, which is taken up by the contact surface 14 or the recess 19 in the base plate, the radial flange 9 of the base plate 1 at the center opening 5 has a recess whose angle corresponds at least to the angle $\alpha$. Angle $\alpha$ can be 120°, for example. At the contact surface 13 on the projection 14 and at the contact surface 20 on the base plate 1 there are radial toothing arrangements (not shown) for forming a positive locking.

The four elongated holes 11 are distributed in such a way that two are respectively arranged on each half of the center disk 6, wherein they are arranged at the same distance from diameter D of the center disk 6. The elongated holes 11 run parallel to diameter D of the center disk 6.

In order to cover all riding styles the base plate must be able to rotate up to 45° with respect to the center disk 6. I.e. the front foot is usually positioned between 10° and 35° in the direction of travel, whereas the rear foot is positioned from 10° in the direction of travel to 10° away from the direction of travel.

To manage with a slit 16 with an angle of max. 45° the diameter D must intersect the curved slit 16 in the projection 14 in such a way that the slit 16 has a section A with an angle of 10° and a section C with an angle of 35°. Whereupon in FIG. 4, viewing the binding from below, the 10° section A and the 35° section B is shown for the right foot.

The invention claimed is:

1. Snowboard binding with a base plate and a center disk in a circular center opening in a center of the base plate, wherein the center disk rests with a circumferential section oriented towards a snowboard on an edge section of the base plate which expands away from the snowboard at the center opening and the center disk is provided with fastening openings for fastening elements for fixing the center disk and thus the base plate to the snowboard, and with a locking device which is arranged on the edge section of the base plate at the center opening and secures the center disk at the base plate against rotational movement, wherein a contact surface is provided on the base plate and on the circumference of the center disk respectively, the locking device presses the contact surface on the base plate in vertical direction towards the snowboard against the contact surface on the circumference of the center disk and the contact surface on the circumference of the center disk is provided on a radial projection of the center disk, which is designed as one piece with the center disk, the locking device for pressing together the contact surfaces on the center disk and the base plate comprising a screw which engages in the center disk and in the base plate in an area of the contact surfaces.

2. Snowboard binding according to claim 1, wherein the contact surface of the center disk and/or the contact surface on the base plate has a friction or positive connection against rotational movement of the center disk with respect to the base plate.

3. Snowboard binding according to claim 2, wherein the positive connection is formed by a toothing arrangement.

4. Snowboard binding according to claim 1, wherein the screw penetrates a circular-arc shaped slit about the center of the center disk in the area of the contact surfaces on the center disk and/or the base plate and is provided with an extension which overlaps the center disk and/or the base plate at the slit.

5. Snowboard binding according to claim 1, wherein the contact surface of the base plate is provided in a recess of the base plate.

6. Snowboard binding according to claim 1, wherein the circumferential section on the center disk and the edge section of the base plate which expands away from the snowboard at the center opening are of a smooth design.

7. Snowboard binding according to claim 1, wherein the circumferential section on the center disk and the edge section of the base plate which expands away from the snowboard at the center opening are of a curved or stepped design in their cross section.

8. Snowboard binding according to claim 1, wherein the base plate stands out with its bottom side by less than 0.5 mm over the bottom side of the center disk.

9. Snowboard binding with a base plate and a center disk in a circular center opening in a center of the base plate, wherein the center disk rests with a circumferential section oriented towards a snowboard on an edge section of the base plate which expands away from the snowboard at the center opening and the center disk is provided with fastening openings for fastening elements for fixing the center disk and thus the base plate to the snowboard, and with a locking device which is arranged on the edge section of the base plate at the center opening and secures the center disk at the base plate against rotational movement, wherein a contact surface is provided on the base plate and on the circumference of the center disk respectively, the locking device presses the contact surface on the base plate in a vertical direction towards the snowboard against the contact surface on the circumference of the center disk and the contact surface on the circumference of the center disk is provided on a radial projection of the center disk, which is designed as one piece with the center disk, the fastening openings on both sides of a diameter of the center disk being arranged at the same distance from the diameter wherein the contact surface of the center disk encloses on one side of the diameter an angle that is smaller than the angle of the contact surface on the other side of the diameter.

10. Snowboard binding according to claim 9, wherein the fastening openings are designed as elongated holes which run parallel to the diameter of the center disk.

11. Snowboard binding comprising:

a base plate including a circular center opening in a center of the base plate and an edge section extending about the center opening, wherein one portion of the edge section includes a recess for opening toward the snowboard, the recess having a face defining a base plate contact surface;

a center disk for placement in the center opening of the base plate, the center disk including fastening openings to receive fastening elements for securement into inserts of a snowboard whereby the center disk is fixedly mounted to the snowboard, the center disk including a flange extending about a periphery thereof and a radial projection projecting radially outwardly beyond the flange about a portion of the circumference thereof, the radial projection being received within the recess of the base plate and including a projection contact surface facing the base plate contact surface; and a locking device for securing the base plate onto the center disk by pressing the base plate contact surface of the edge section having the recess towards the snowboard and into contact with the projection contact surface to prevent rotational movement of the base plate relative to the center disk.

12. Snowboard binding according to claim 11, wherein at least one of the projection contact surface and the base plate contact surface has a friction or positive connection against rotational movement of the center disk with respect to the base plate.

13. Snowboard binding according to claim 12, wherein the recess defining the base plate contact surface of the one portion of the edge section of the base plate comprises a first recess, another portion of the edge section of the base plate defining a second recess having an opening contact surface oriented in an opposite direction to the base plate contact surface formed by the first recess, said second recess for receiving the flange of said center disk along the another portion of the edge section.

14. Snowboard binding according to claim 11, the radial projection of the center disk including a circular-arc shaped slit extending along a circumferential path of the projection relative to a center of the center disk for receiving the locking device.

15. Snowboard binding according to claim 14, the locking device comprising a screw that penetrates the circular-arc shaped slit about the center of the center disk in the area of the projection contact surface and the base plate contact surface, wherein the radial projection includes a nut secured thereto for receiving the screw, tightening of the screw causing the base plate contact surface and the projection contact surface to contact each other.

16. Snowboard binding according to claim 11, wherein the locking device for pressing together the contact surfaces on the center disk and the base plate engages the base plate in the area of the base plate contact surface and engages the radial projection of the center disk in the area of the projection contact surface.

17. Snowboard binding according to claim 11, wherein the base plate is rotatable up to 45 degrees with respect to the center disk.

* * * * *